US009331427B2

(12) United States Patent
Tedeschi

(10) Patent No.: US 9,331,427 B2
(45) Date of Patent: May 3, 2016

(54) ELECTRICAL CONNECTING DEVICE WITH SPRING CONNECTING ELEMENT WITH COMPACT ACTUATOR AND MULTI-POLE CONNECTOR COMPRISING A PLURALITY OF SAID SPRING CONTACTS

(71) Applicant: INDUSTRIA LOMBARDA MATERIALE ELETTRICO - I.L.M.E. S.P.A., Milan (IT)

(72) Inventor: Tito Alessandro Tedeschi, Bollate (IT)

(73) Assignee: INDUSTRIA LOMBARDA MATERIALE ELETTRICO—I.L.M.E. S.P.A., Milan (IT)

( * ) Notice: Subject to any disclaimer, the term of this patent is extended or adjusted under 35 U.S.C. 154(b) by 96 days.

(21) Appl. No.: 14/177,740

(22) Filed: Feb. 11, 2014

(65) Prior Publication Data

US 2014/0227914 A1 Aug. 14, 2014

(30) Foreign Application Priority Data

Feb. 12, 2013 (IT) ..... M12013A0200

(51) Int. Cl.
*H01R 4/48* (2006.01)
*H01R 13/629* (2006.01)

(52) U.S. Cl.
CPC ..... *H01R 13/629* (2013.01); *H01R 4/4836* (2013.01); *H01R 4/4845* (2013.01)

(58) Field of Classification Search
CPC ... H01R 4/4845; H01R 4/4827; H01R 4/4818
USPC ..... 439/828, 829, 836, 835
See application file for complete search history.

(56) References Cited

U.S. PATENT DOCUMENTS

| | | | | |
|---|---|---|---|---|
| 4,685,761 | A * | 8/1987 | Locati | 439/843 |
| 5,730,628 | A * | 3/1998 | Hawkins | 439/843 |
| 6,042,432 | A * | 3/2000 | Hashizawa et al. | 439/843 |
| 6,783,385 | B2 * | 8/2004 | Rudy | 439/438 |
| 7,438,587 | B2 * | 10/2008 | Germani | 439/441 |

(Continued)

FOREIGN PATENT DOCUMENTS

| | | |
|---|---|---|
| DE | 27 06 482 A1 | 8/1978 |
| DE | 10145324 A1 | 4/2003 |

(Continued)

OTHER PUBLICATIONS

European Search Report dated Oct. 2, 2013; IO 37508 IT M20130200.

*Primary Examiner* — Phuong Dinh
(74) *Attorney, Agent, or Firm* — Ladas & Parry LLP

(57) ABSTRACT

Electrical connecting device including an insulating body with parallel longitudinal seats and, respectively adapted to accommodate a connecting element with spring terminal and an actuator pin with profile cam facing a spring of the terminal to cause the opening and closing of said terminal by means of sliding in the corresponding seat, said spring being a ring-shaped spring with a curved lower portion, a back ascending portion engageable by a protruding portion of said cam profile of the actuator pin and an upper portion with a slot adapted to receive at least one electrical conductor, characterized in that in said actuator pin a hollow seat delimited by two lateral walls is provided adapted to receive the aforementioned ascending leg of the spring-shaped ring in condition of maximum extroversion of the spring, i.e. upon empty closed terminal.

15 Claims, 11 Drawing Sheets

(56) References Cited

U.S. PATENT DOCUMENTS

| | | | | |
|---|---|---|---|---|
| 8,773,671 | B2 * | 7/2014 | Inui et al. | 358/1.13 |
| 2003/0194918 | A1 * | 10/2003 | Fricke et al. | 439/835 |
| 2004/0152355 | A1 | 8/2004 | Rudy | |
| 2009/0061700 | A1 * | 3/2009 | Coe et al. | 439/843 |

FOREIGN PATENT DOCUMENTS

| | | | |
|---|---|---|---|
| DE | 102007009082 | A1 | 9/2007 |
| EP | 1294053 | A2 | 2/2014 |
| JP | 06-215810 | A | 8/1994 |

* cited by examiner

ELECTRICAL CONNECTING DEVICE WITH SPRING CONNECTING ELEMENT WITH COMPACT ACTUATOR AND MULTI-POLE CONNECTOR COMPRISING A PLURALITY OF SAID SPRING CONTACTS

The present invention relates to an electrical connecting device with a spring connecting element, in particular an electrical connecting terminal for the connection of one or more electrical conductors, equipped with a compact actuator. In particular, without excluding other embodiments of the invention, the electrical connecting element is in the form of an electric contact element, either male (plug) or female (socket).

In particular, the electrical connecting device in question may also be suitable to be housed in the insulating body of a multipole connecting device, such as an electrical connector, for connecting an electrical conductor either of a type with a plurality of strands (flexible conductor) or of the single-wire type (rigid or flexible but prepared with a crimped ferrule termination).

STATE OF THE ART

Elements of electrical connection and electrical connection terminals suitable for connecting one or more electrical conductors through the action of a tension spring are known.

Among the most common forms of tension spring for said elements there is one described in DE 2706482 (Wago), in particular made from a strip of resilient material shaped in the manner of a ring.

In DE 102007009082 (ILME) an evolution of such connecting devices with spring contacts is described which provides for the presence, for each terminal, of an actuator in the form of a sliding pin that operates the closing or opening of the tension spring and consequently the connection or the release of the conductor to/from the terminal without the use of a tool (e.g. with a screwdriver with slot shaped tip) for closing the connection terminal for the realization of the electrical connection between the conductor and the contact, making said tool necessary only for any subsequent reopening. This invention has rendered the wiring operation independent of the operator, i.e. from the level of training and expertise of the operator.

In IT MI2012A00001974 (ILME), not yet published, a further evolution of the invention previously invoked is described, in which the actuators of the spring connecting elements are provided with a longitudinal groove adapted to allow, for example, the introduction of a metal probe to perform electrical measurements.

PROBLEMS OF THE PRIOR ART

The electrical connecting devices with spring contacts and actuator of the prior art, based on the typical ring shape of the spring referred to in the aforementioned DE 2706482, suffer the inconvenience of determining a rather remarkable transverse dimension: the actuator pin, frontwards shaped with a cam profile, so as to operate the opening and closing of the spring terminal by acting on the so-called "leg" of the spring, has by necessity, upon connecting element in the "open" position, a transverse dimension, rearwards of the spring itself, which yields to a limitation of the density of the spring connecting elements with actuator, implementable on adjacent parallel rows, for example in multipole compact terminal blocks or in multipole electrical connectors.

For the relevant slots in the insulating body of the multipole terminal block or of the multipole connector, consistent transverse dimensions are hence required, such as to prevent the adoption of such electrical spring connecting elements with actuator in multipole devices with a high contact density, in particular when e.g. the multipole connector insert is limited in its maximum size by the useful internal size of the respective protective housing.

An alternative embodiment of the actuator pin in the prior art devoid of transverse dimensions posteriorly to the spring, while not varying the shape of the latter with respect to the classic one of the prior art, provides a greater overall width of the actuator pin itself, which embraces the spring to the sides, but for a connecting device equipped with such an electrical spring-type connecting element with actuator, it involves a greater width dimension due to the necessarily increased lateral dimension of the actuator pin. This makes it inconvenient to use such a connecting element in preexisting multipole connecting devices, for the increase of pitch that would be required between such connecting elements arranged side by side.

An alternative of spring-type connecting element with actuator based on a different spring design, with a spring element with a sleeve shape, is described in DE 10145324 (EP 1294053) (Harting). This technique, although more compact, suffers however from serious drawbacks: (1) it is still necessary a tool (e.g. screwdriver with slot shaped tip) for the closure of the terminal, because of the small size of the actuator pin and (2) it is only suitable for stranded flexible conductors, thus not for conductors prepared with insulated crimp ferrule (a solution much appreciated by the manufacturers of wiring harness for electric panels) or single-pole conductors, either solid or stranded, the use of which is still widely diffused in many countries for the wiring of fixed electrical installations.

PURPOSE OF THE INVENTION

The purpose of the present invention is therefore to eliminate the drawbacks of the above described prior art, in particular to provide an electrical connecting device with a spring-type connecting element as described in DE 2706482, provided with actuator as foreseen in DE 102007009082, which has a compact shape, so as to reduce the transverse dimensions of the device, and to increase the density of the connecting elements in case of use of the same in multipole connectors, while keeping all the advantages offered by the spring-type connecting element with a ring-shaped spring. Another purpose of the invention is to provide such an electrical connecting device suitable for both flexible and rigid conductors and suitable to accommodate even more than one conductor.

Further object of the invention is to provide such an electrical connecting device which is simple and economical to produce.

DESCRIPTION OF THE INVENTION

The electrical connecting device according to the invention has the characteristics of independent claim 1.

Advantageous embodiments of the invention are set forth in the dependent claims. Basically, the electrical connecting device according to the invention, comprising a body that houses the spring-type connecting element and the actuator, presents a reshaping of the tension spring of the connecting element, in particular in a limited portion of the so-called "leg" of the ring-shaped spring (also known as cage), which acts as a lever arm for the closure of the portion which operates as the veritable spring, constituted by a lower portion curved in a semicircle.

The portion of the above mentioned "leg" is suitably symmetrically tapered on the sides and the corresponding profile of the actuator pin is specularly hollowed in such a way to completely wrap the aforementioned tapered rear portion of the tension spring, when the spring-type connecting element is in fully closed terminal position (and the cage spring is at its maximum extension).

Thus, compared to the known technique, the overall transverse dimensions of the actuator pin becomes usefully reduced down to zero in the closed terminal position (the position of maximum transverse dimension).

It is therefore made possible to house an electrical spring-type connecting element with actuator such as this e.g. in compact multipole terminal blocks or in high density multipole connectors which foresee more rows of adjacent and close together contacts. In particular, for use in multipole connectors, one obtains maintaining the maximum transverse footprint of the spring-type connecting element with actuator equal to that required in similar multipole connectors with spring-type connecting devices without actuator. Hence, the same mating interface (thus the same contact density) of the existing multipole spring-type connectors without actuator can be kept in the spring-type versions with actuator.

BRIEF DESCRIPTION OF DRAWINGS

Further characteristics of the invention will appear more clearly from the detailed description that follows, referring to a merely exemplary, and therefore non-limiting, embodiment, illustrated in the enclosed drawings, in which:

FIG. 5 in the open terminal position with actuator pin fully extracted,

FIG. 6 in the open terminal position with actuator pin fully extracted and with conductor inserted into the corresponding housing seat, FIG. 7 in the closed terminal position with wire and actuator pin inserted in their seats, FIG. 8 in the closed terminal position as in FIG. 7 with the tip of a screwdriver inserted in a lateral seat of the actuator pin, FIG. 9 in the open terminal position with the actuator pin lifted by the tip of the screwdriver and the conductor extracted;

DETAILED DESCRIPTION OF A PREFERRED EMBODIMENT

Figure 1:
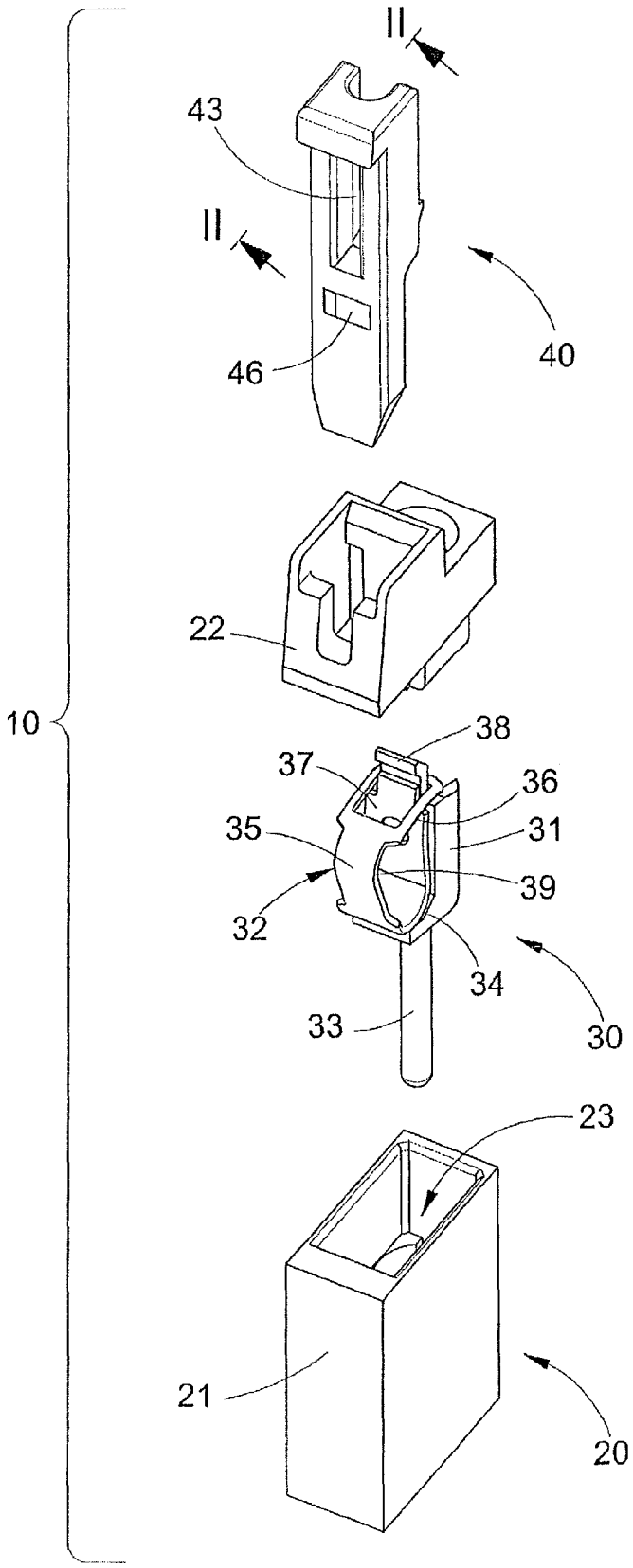
FIG. 1 is an axonometric exploded view of an electrical connecting device according to the invention.
Figure 2:
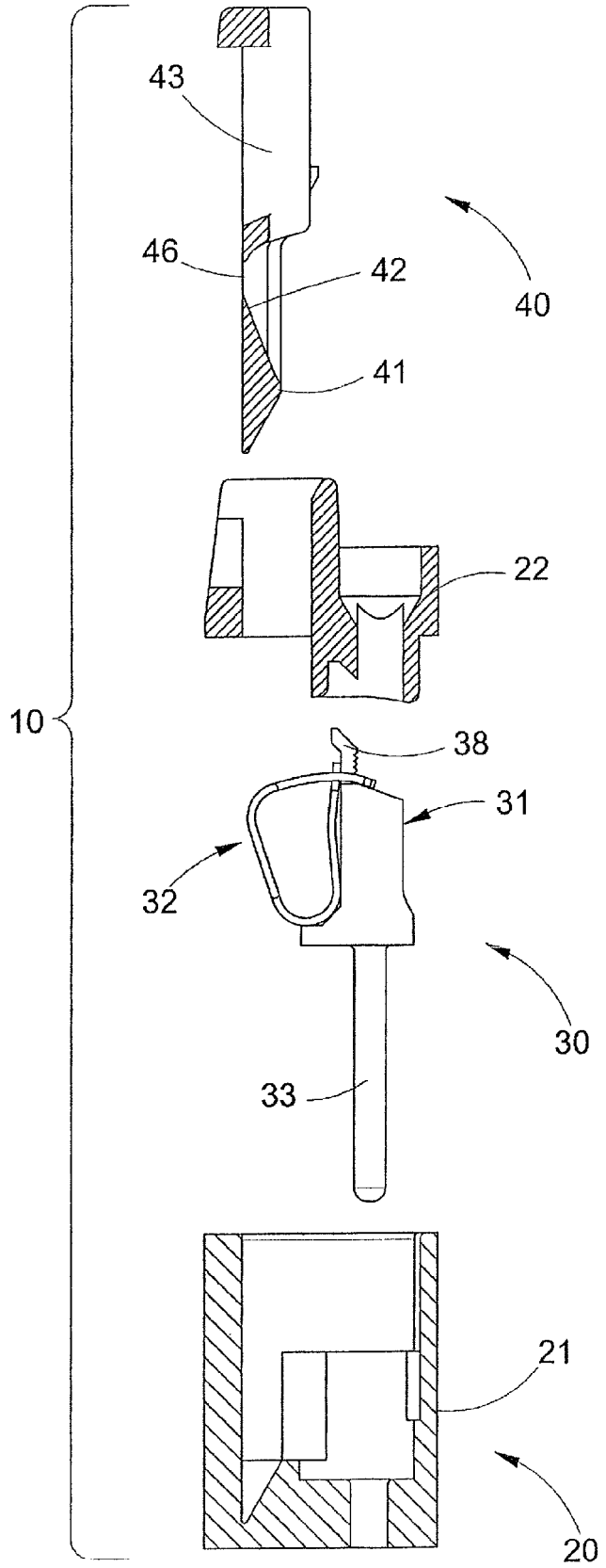
FIG. 2 is a cross-sectional view, taken along the plane II-II of the exploded view of FIG. 1.
Figure 3A:
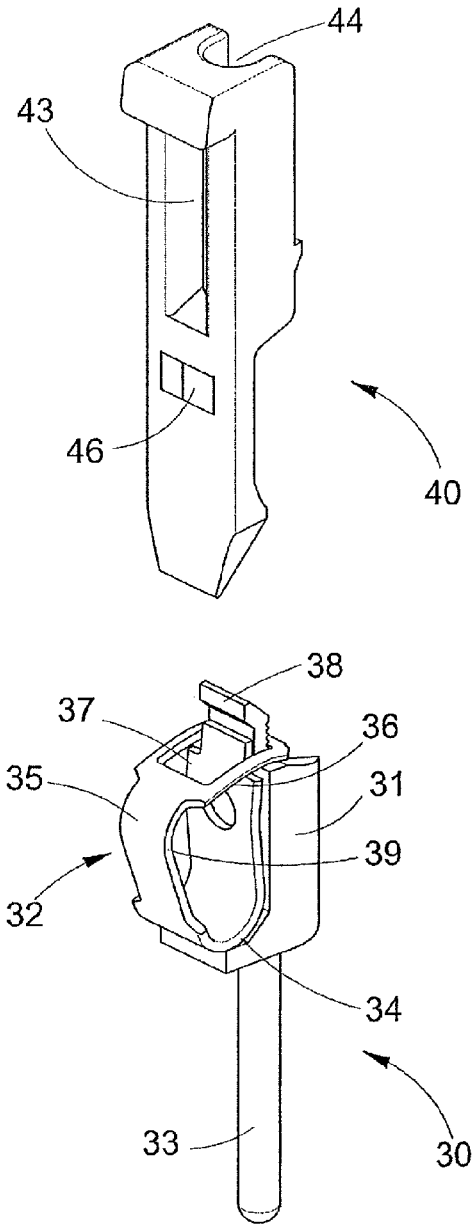
FIG. 3*a* is an isometric view showing an exploded view of the spring-type electrical connecting element and the actuator pin of the connecting device according to the invention.
Figure 3B:
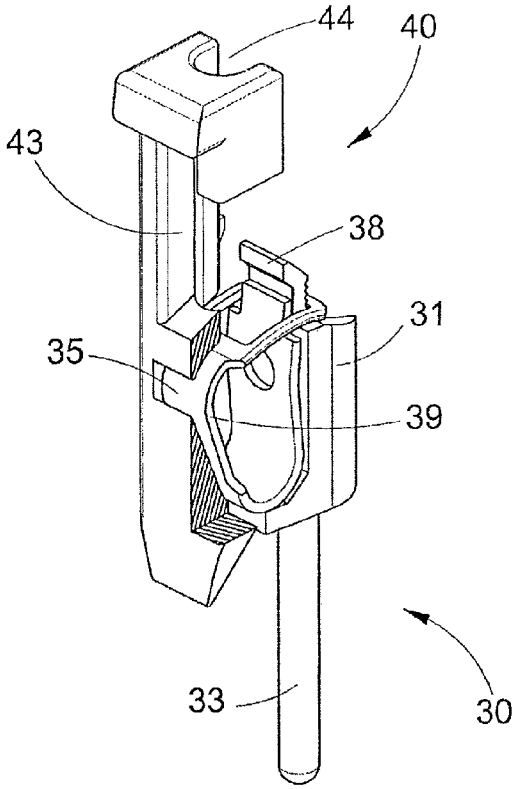
FIG. 3*b* shows the elements of FIG. 3*a* in the assembled condition, in closed terminal position, void, without conductor, working a partial sectioning of the actuator pin (hatched area)
Figure 3C:
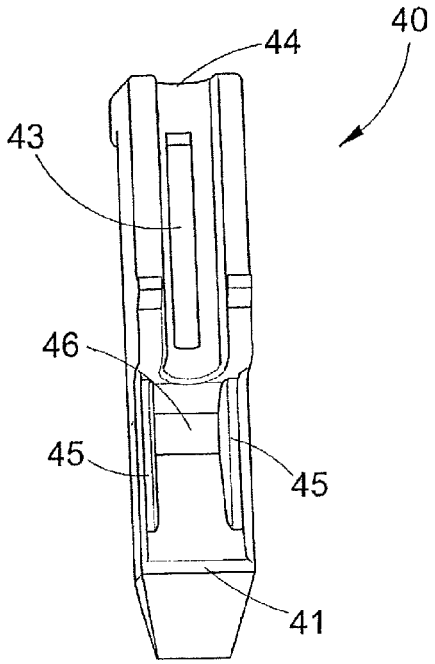
FIG. 3*c* is an isometric view of the actuator pin alone taken from the opposite side with respect to FIG. 3*a;*

In FIGS. 1 to 9 an exemplary embodiment of an electrical connecting element according to the invention is shown, globally designated by the reference number 10. It comprises an electrical insulating body 20, consisting of a base 21 and a cover 22, which when assembled (FIGS. 4-9) determine two longitudinal parallel seats, upwardly opened 23, 24 adapted to house, respectively, an electrical connecting element 30 and an actuator pin 40, formed as described in the aforementioned document DE 102007009082, with the modifications that will be described.

The connecting element 30 has a terminal 31 with ring-shaped tension spring (also known as cage) 32 and, in the example reported, a pin-shaped male electric contact element 33 downwardly protruding from the insulating body 20. Alternatively, the electric contact element 33 may be of the socket female type.

The tension spring 32, known per se, as described in DE 2706482, is a leaf spring that has just a closed ring conformation, with a curved lower portion, substantially in a semicircle 34 which acts as the veritable spring, a back ascending portion that will be called "leg" 35 and an upper portion 36 with a slot 37 housing in an upper protrusion 38 of the connecting element 30 or of a portion of spring opposite to the leg 35, to allow the flexing of the spring as a result of an external stress, and therefore the opening and closing of the terminal.

The actuator pin 40 is of prismatic shape with vertical longitudinal development and can slide in the respective seat 24 to actuate the spring 32 and open or close the terminal. In particular, the actuator pin 40 has at the bottom a front profile of the cam type with a projecting portion 41 adapted to interfere with the said spring 32 to operate the opening and closing of the terminal, and a depression 42 adapted to house said leg 35 of the spring 32 in the closed terminal condition and in absence of the conductor.

The actuator pin 40 also presents an upper side seat 43 for a manual tool such as a screwdriver with slot shaped tip 50 (see particularly FIGS. 7 and 8) for the reopening of the terminal, substantially as described in the aforementioned document DE 102007009082.

The actuator pin 40 also presents a longitudinal aperture 44 facing in the direction of the spring 32, adapted to allow the insertion of the probe of a testing device for making electrical measurements, as described in the aforesaid not yet published IT MI2012A001974 patent application.

Figure 4B:
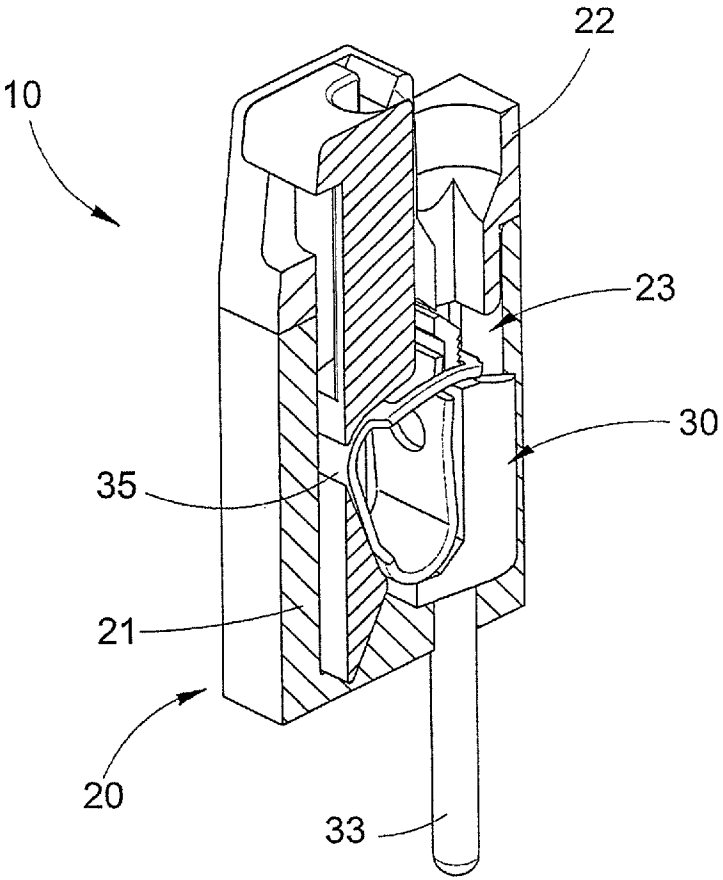
FIG. 4*b* is an isometric view of the section of FIG. 4*a;*
Figure 4A:
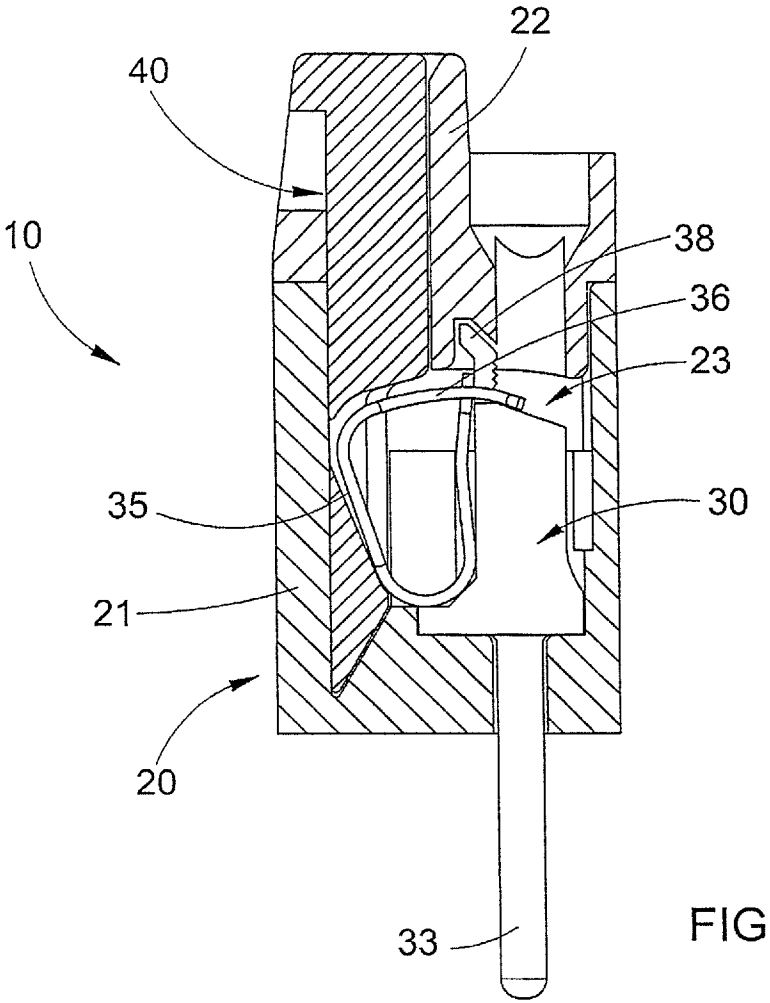
FIG. 4*a* is a cross-sectional view like that of FIG. 2, showing the assembled electrical connecting device, upon closed terminal, void, without conductor, as in FIG. 3*b;*

The substantial differences of the connecting device according to the present invention compared to the one described in the document DE 102007009082, which allow to reduce the device's internal transverse dimensions, and thus to obtain an increase of the density of connecting elements in case of multipole terminal blocks or connectors, consist in the fact that the aforementioned depression 42 formed in the actuator pin 40 is a recessed seat in the thickness of the pin, delimited by two opposite vertical walls 45 (best seen in FIG. 3*c*), and the aforesaid ascending leg portion 35 of the spring 32 shows the respective sides tapered or grooved 39, so as to fit into the corresponding hollow seat 42 of the actuator pin in closed terminal condition, at rest, without conductor, as shown in FIGS. 4*a* and 4*b*. In this rest condition, to allow the complete fit of the leg 35 of the spring 32 in the hollow seat 42 of the actuator pin 40, on the bottom of this a window 46 is provided so as to allow the complete extroversion of the spring.

Figure 5B:
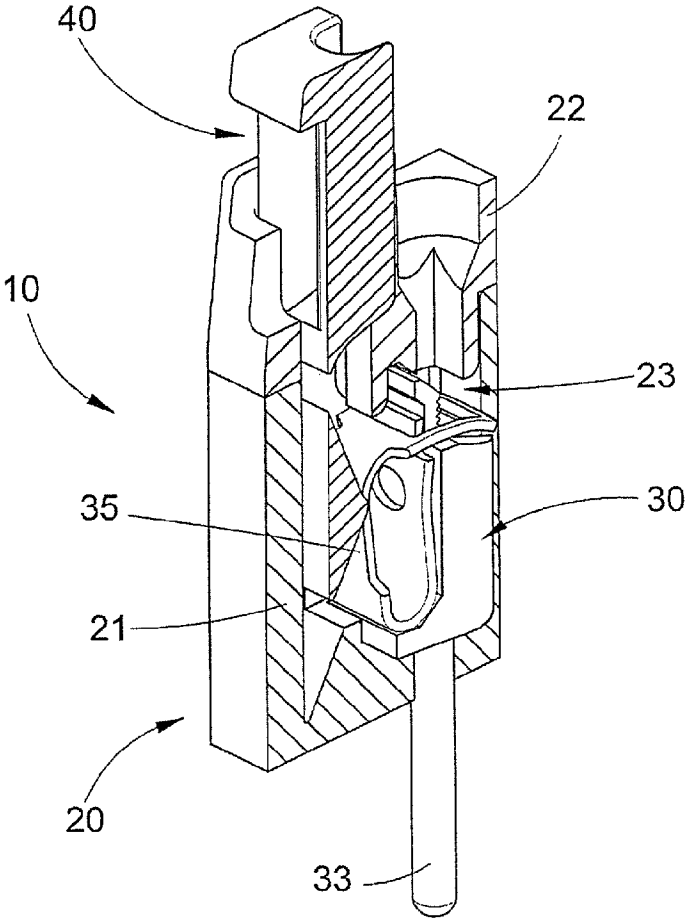
FIGS. 5-9 *a*), *b*), are similar to those of FIGS. 4*a, b,* showing the electrical connecting device in different configurations corresponding in sequence to the different stages of wiring and of possible reopening, in particular.
Figure 5A:
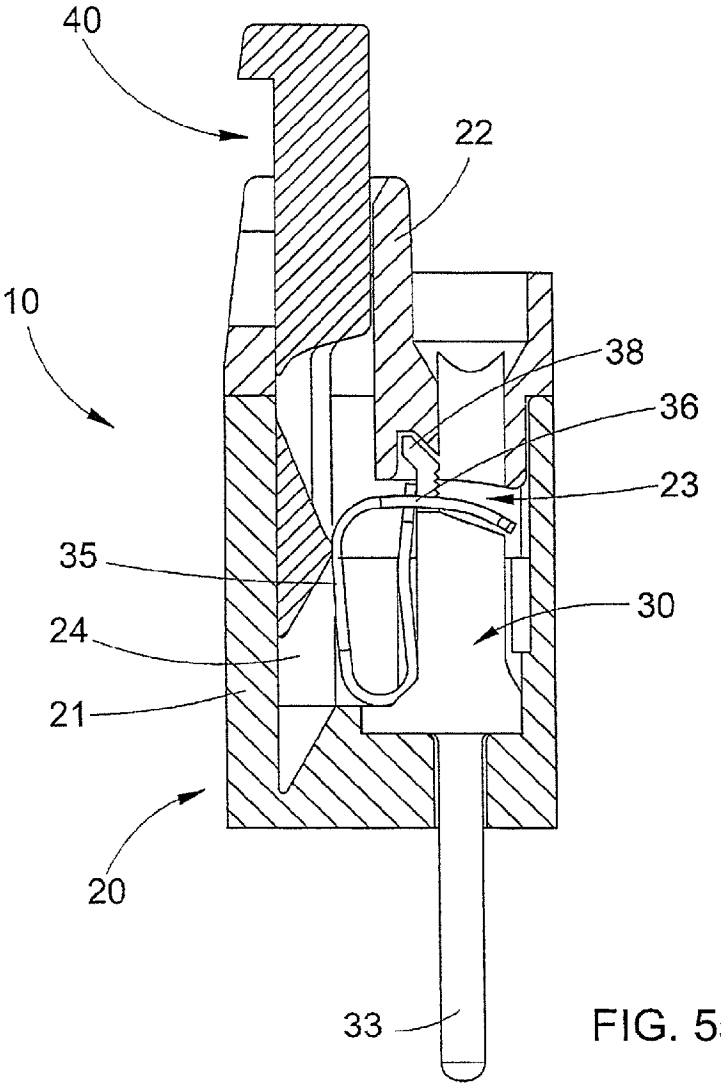
Figure 6B:
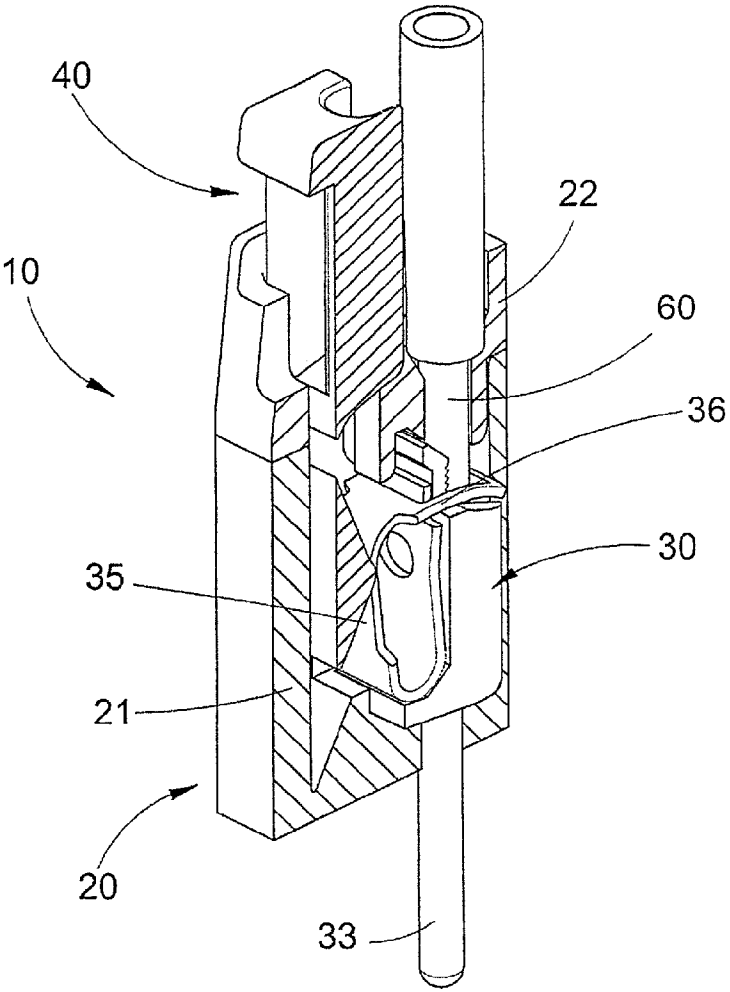
Figure 6A:
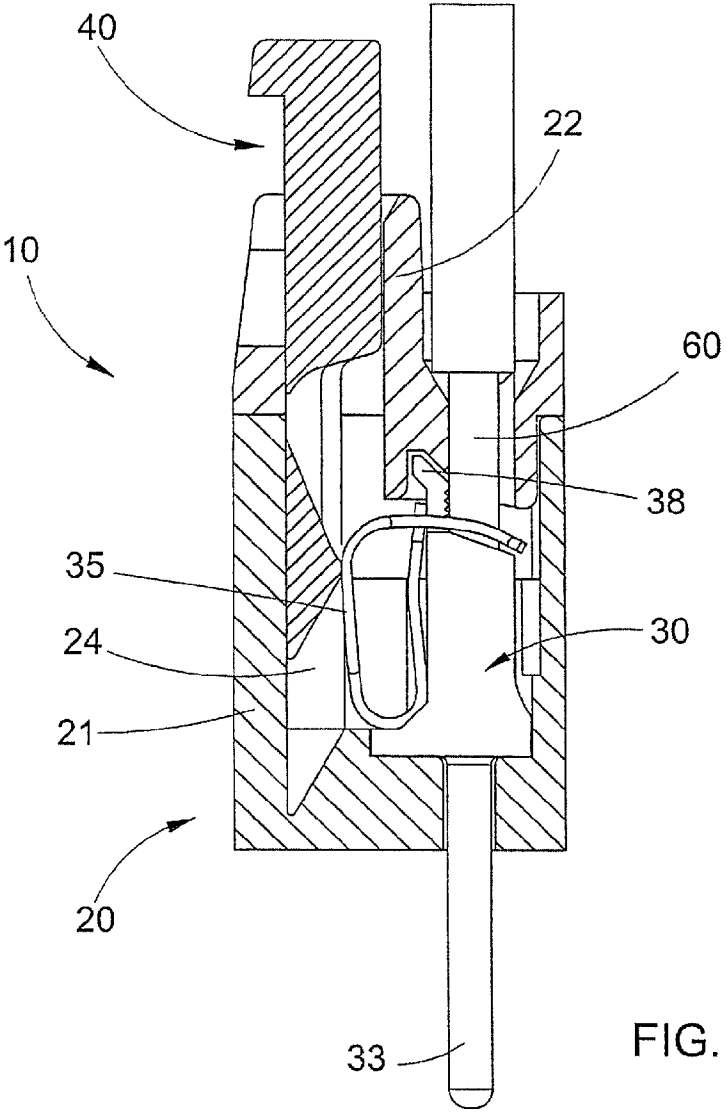

With reference to FIGS. 5 to 9 it is now briefly described the operation of the electrical connecting device according to the invention, which is completely identical to that described and illustrated in the aforementioned document DE 102007009082. In FIG. 5 the device is in the open terminal condition, without conductor, with actuator pin 40 completely extracted in its housing seat 24 and the ring-shaped spring 32 compressed by the protrusion 41 of the cam profile of the actuator, so that the upper slot 37 of the spring is ready to receive an electrical conductor 60, as shown in FIG. 6. In FIG. 6 and subsequent, a rigid conductor 60 is shown, but it is evident that the electrical connecting element 30 can accommodate either a flexible conductor or even multiple conductors.

Figure 7B:
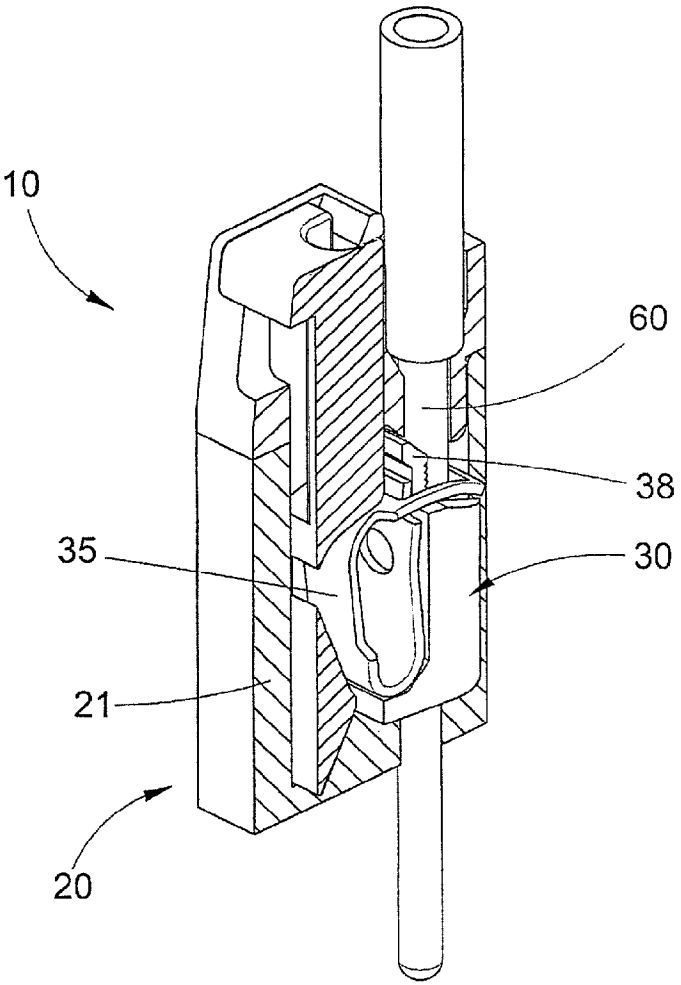
Figure 7A:
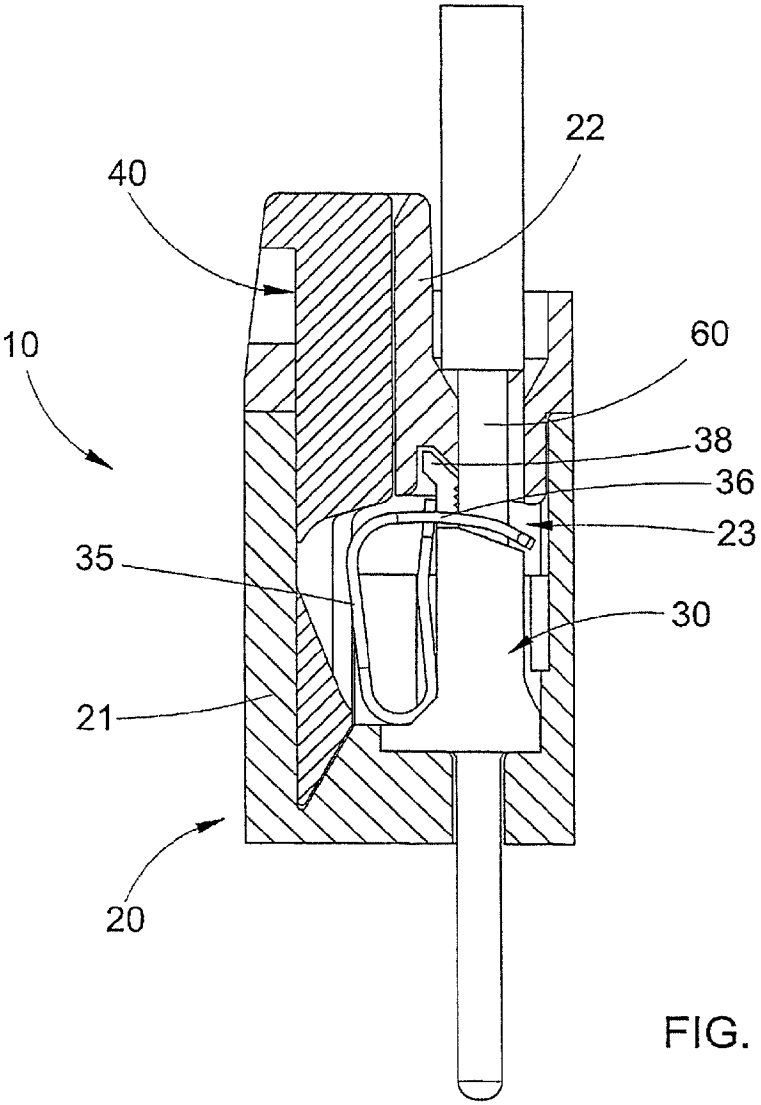

FIG. 7 shows the electrical connecting device in closed terminal condition, with the actuator pin 40 inserted retractable in its seat 24, and the conductor 60 clamped in the spring terminal.

Figure 8B:
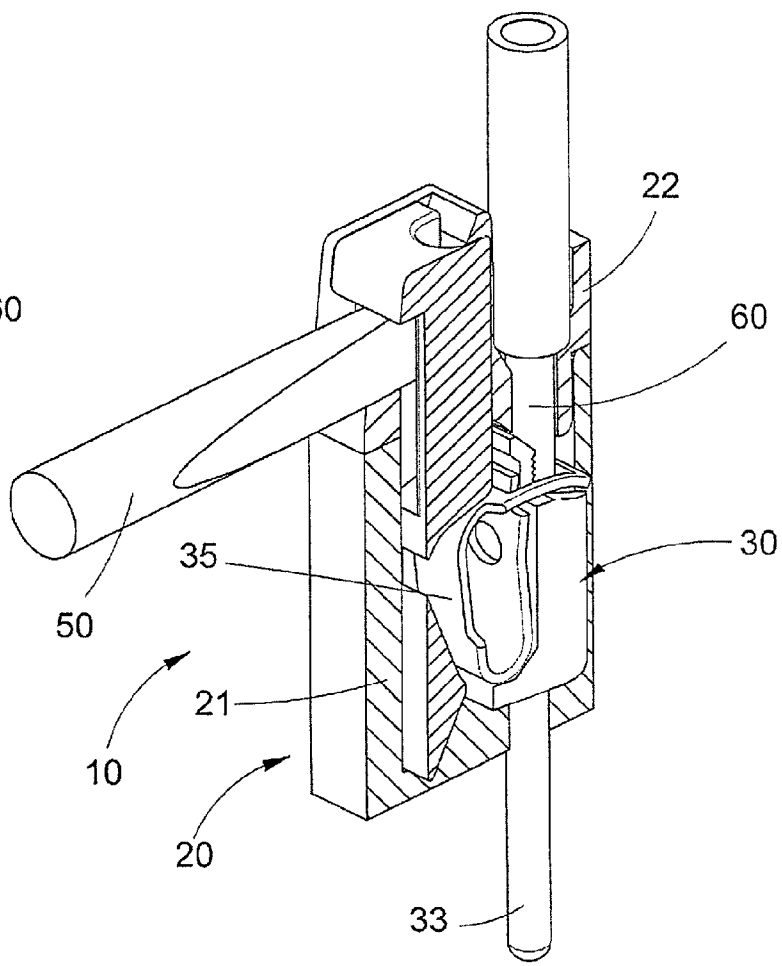
Figure 8A:
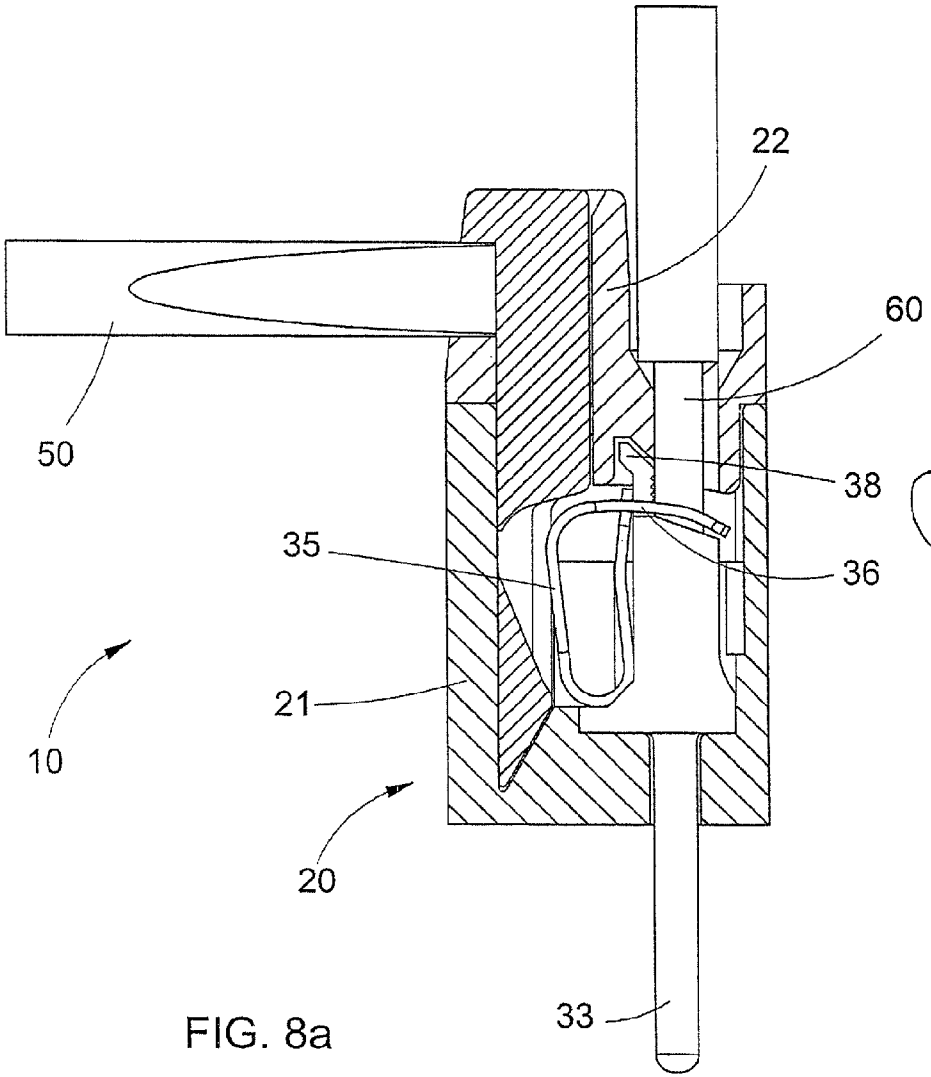

FIG. 8 is a view like that of FIG. 7, and shows the tip of a screwdriver 50 with slotted end inserted into the side slot 43 of the actuator pin 40.

Figure 9A:
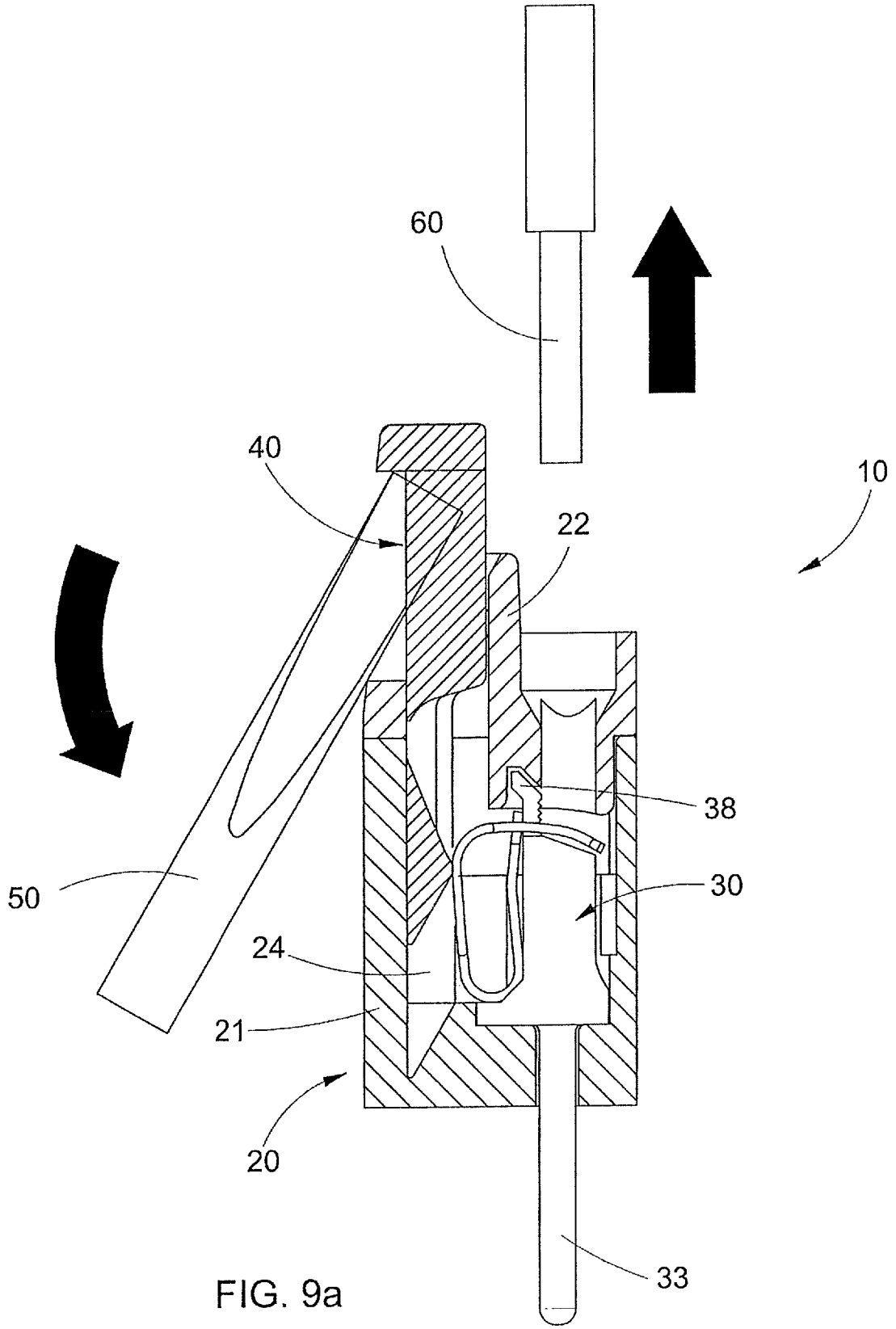
Figure 9B:
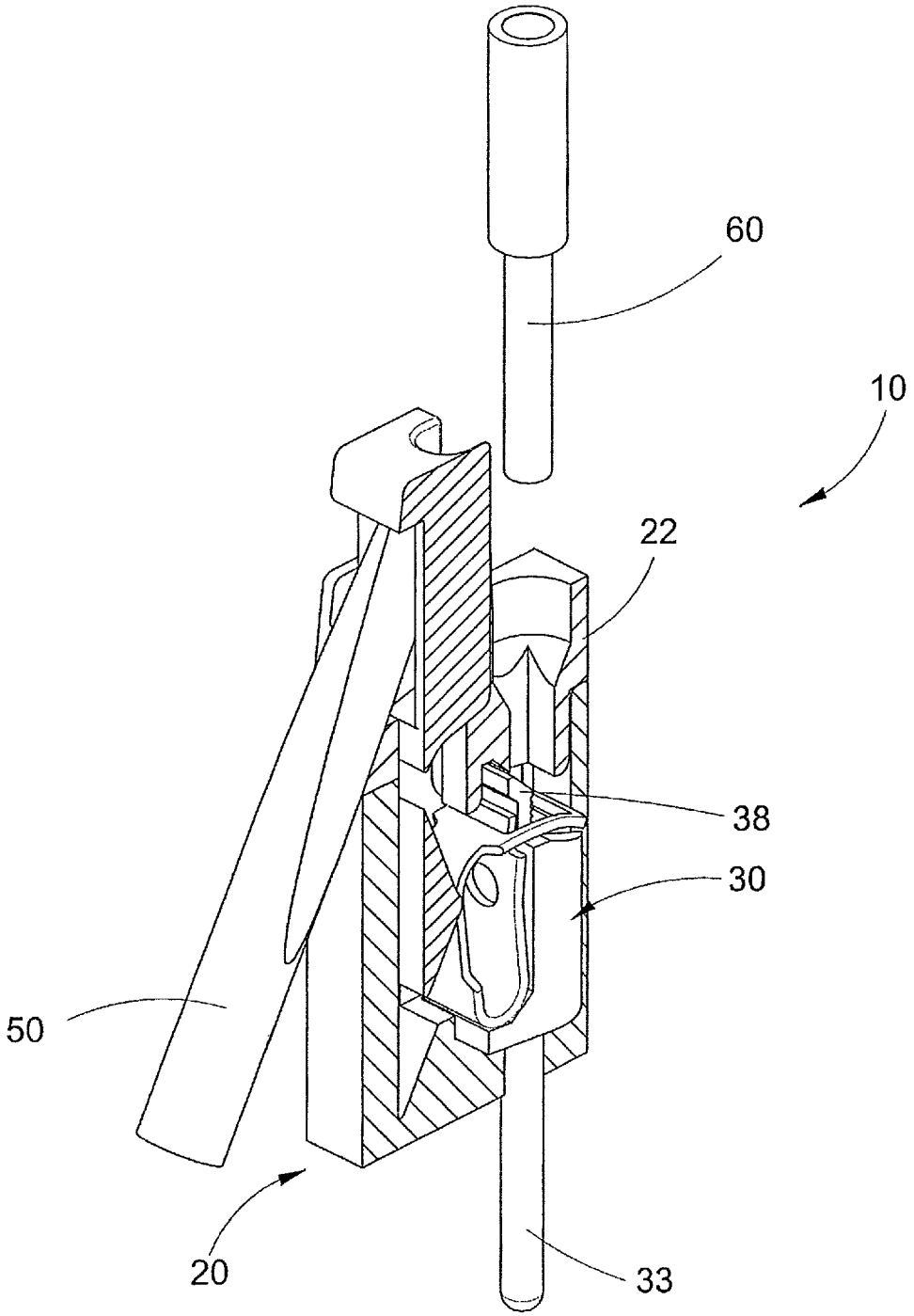

By leveraging on the suitably relieved upper edge of the cover 22 of the body 20 a downward rotation of the screwdriver 50 is operated causing the lifting up of the actuator pin 40, whose protruding portion 41 of the cam profile operates the compression of the spring 32 with the corresponding opening of the connection and the release of the conductor 60 which can be extracted, as shown in FIG. 9.

Figure 10:
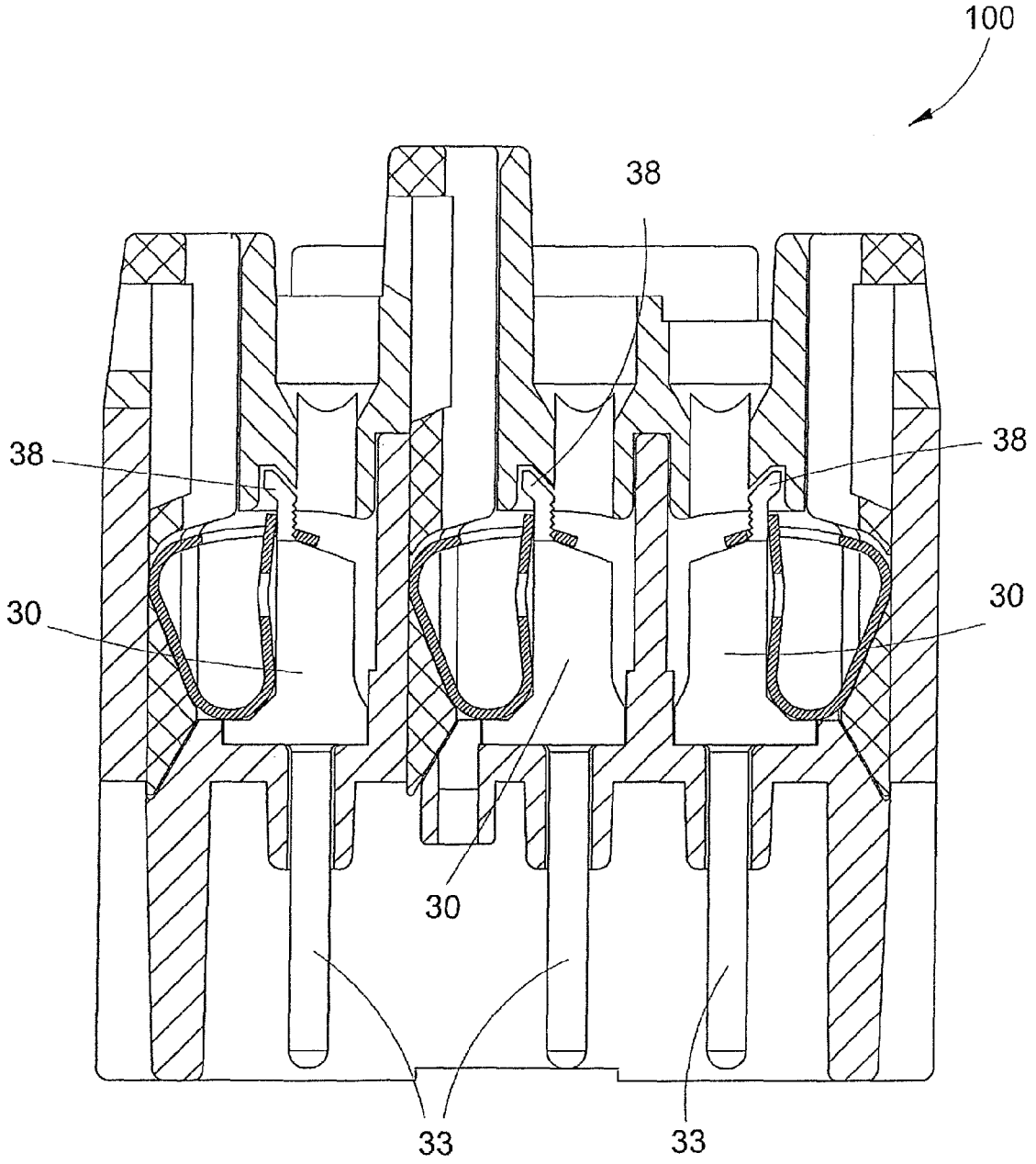
FIG. 10 is a cross-sectional view like that of FIG. 4*a*, of an exemplification of a multipole connector provided with connecting elements and actuating pins as shown in the previous figures.

FIG. 10 is a cross-section showing an example of multipole connector 100 with three contact rows with actuator pins 40 inserted retractable in the respective seats of the insulating body of the connector, closed spring terminals (empty, without wires), situation of maximum extroversion of the rear leg portion 35 of the ring-shaped springs 32. The overall width of the actuator pin 40 is canceled, due to the tapering of the rear leg of the springs and the corresponding hollow seat 42 formed in the actuator pin 40 and the window 46 provided in the bottom of these seats, so that the actuator pins sectioned transversely from the plane passing to the point of maximum extroversion of the springs have zero thickness. In this way, in the rest position (empty closed terminals) the completely extroverted springs are introjected in the corresponding cavities formed in the actuator pins minimizing the transverse dimension of the assembly and allowing the provision of such spring-type connecting elements with actuator in high density connecting devices or to equip with actuators the spring-type connecting elements of existing devices without requiring the increase of the transverse dimension.

In particular, in the example shown in FIG. 10, by using spring-type contacts and actuator pins of the prior art, in particular as those described in DE 102007009082 it would not have been possible to obtain, with the same transverse dimension of the connector body, three rows of electrical contacts.

From the foregoing, the advantages of the invention appear evident, which is not however limited to the particular embodiment previously described and illustrated in the appended drawings, but which can be subject to numerous modifications of detail within reach of the technician skilled in the art, without departing from the scope of the invention defined by the appended claims.

The invention claimed is:

1. Electrical connecting device comprising an electrical insulating body with at least one pair of longitudinal parallel seats and adapted to house, respectively, a connecting element with a spring terminal and an actuator pin having a cam profile oriented towards a spring of the terminal to cause the opening and closure of the terminal by sliding into the corresponding seat, said spring being a ring-shaped spring having a curved lower portion, a back ascending portion in form of a leg engageable with a projecting portion of said cam profile of the actuator pin and an upper portion with a slot adapted to receive at least one electrical conductor, characterized in that said actuator pin is provided with a hollow seat delimited by two lateral walls adapted to receive said ascending leg of said ring-shaped spring when the spring is in the maximum extroversion status, that is when the terminal is closed and empty and in that said ascending leg of the spring has the tapered sides to be housed in said hollow seat of the actuator pin.

2. Electrical connecting device according to claim 1, characterized in that said actuator pin has a width not greater than that of said terminal.

3. Electrical connecting device according to claim 1, characterized in that the bottom of said hollow seat of the actuator pin is provided with a window.

4. Electrical connecting device according to claim 1, wherein said actuator pin has a side seat for the insertion of a tool tip, such as a screwdriver.

5. Electrical connecting device according to claim 1, characterized in that said actuator pin has a longitudinal aperture oriented along the direction of said spring, adapted to allow the insertion of a tester device probe for electrical measurements.

6. Electrical connecting device according to claim 1, wherein said electrical insulating body comprises a base and a cover.

7. Electrical connecting device according to claim 1, wherein at least one conductor is a flexible or rigid.

8. Multipolar electrical connector incorporating a plurality of electrical connecting elements having a spring terminal and actuator pins inserted in a rollway fashion inside respective housing seats of the insulating body of the connector having the features according to claim 1.

9. Multipolar electrical connector incorporating a plurality of electrical connecting elements having a spring terminal and actuator pins inserted in a rollway fashion inside respective housing seats of the insulating body of the connector having the features according to claim 2.

10. Multipolar electrical connector incorporating a plurality of electrical connecting elements having a spring terminal and actuator pins inserted in a rollway fashion inside respective housing seats of the insulating body of the connector having the features according to claim 3.

11. Multipolar electrical connector incorporating a plurality of electrical connecting elements having a spring terminal and actuator pins inserted in a rollway fashion inside respective housing seats of the insulating body of the connector having the features according to claim 4.

12. Multipolar electrical connector incorporating a plurality of electrical connecting elements having a spring terminal and actuator pins inserted in a rollway fashion inside respective housing seats of the insulating body of the connector having the features according to claim 5.

13. Multipolar electrical connector incorporating a plurality of electrical connecting elements having a spring terminal and actuator pins inserted in a rollway fashion inside respective housing seats of the insulating body of the connector having the features according to claim 6.

14. Multipolar electrical connector incorporating a plurality of electrical connecting elements having a spring terminal and actuator pins inserted in a rollway fashion inside respective housing seats of the insulating body of the connector having the features according to claim 7.

15. Electrical connecting device comprising an electrical insulating body with at least one pair of longitudinal parallel seats and adapted to house, respectively, a connecting element with a spring terminal and an actuator pin having a cam profile oriented towards a spring of the terminal to cause the spring being a ring-shaped spring having a curved lower portion, a back ascending portion in form of a leg engageable with a projecting portion of said cam profile of the actuator pin and an upper portion with a slot adapted to receive at least one electrical conductor, characterized in that said actuator pin is provided with a hollow seat delimited by two lateral walls adapted to receive said ascending leg of said ring-shaped spring when the spring is in the maximum extroversion status, that is when the terminal is closed and empty and in that said ascending leg of the spring has the tapered sides to be housed in said hollow seat of the actuator pin, characterized in that said actuator pin has a width not greater than that of said terminal, and characterized in that the bottom of said hollow seat of the actuator pin is provided with a window.

* * * * *